US005891299A

United States Patent [19]

Chen

[11] Patent Number: 5,891,299

[45] Date of Patent: Apr. 6, 1999

[54] CARTON SEALER USING PAPER TAPES

[75] Inventor: Tuan-Mei Chiu Chen, Chia-Yi Hsien, Taiwan

[73] Assignee: Tien Heng Machinery Co., Ltd., Chia-Yi Hsien, Taiwan

[21] Appl. No.: 842,084

[22] Filed: Apr. 28, 1997

[51] Int. Cl.[6] ..... B65B 7/16; B65B 61/00

[52] U.S. Cl. ..... 156/486; 156/250; 156/468; 156/475; 156/510; 156/529; 53/136.4

[58] Field of Search ..... 156/475, 486, 156/250, 324, 468, 477.1, 510, 529; 53/136.4

*Primary Examiner*—Laura Edwards
*Assistant Examiner*—Linda L. Gray
*Attorney, Agent, or Firm*—Rosenberg, Klein & Bilker

[57] ABSTRACT

A carton sealer using paper tapes includes a work table, an elevator, two tape machines, and a contact wheel unit. When a carton is placed and moved on the table, it touches a following wheel of an upper tape machine and is adhered with a paper tape. The carton and the following wheel continue to move forward until a micro switch separates from a projection of a turning member of the following wheel and an air cylinder. Then a spring pulls back the following wheel and a press wheel to their original position, finishing one round of tape sealing operation.

2 Claims, 8 Drawing Sheets

CARTON SEALER USING PAPER TAPES

BACKGROUND OF THE INVENTION

This invention concerns a carton sealer using paper tapes, particularly using a paper tape, which is adhered automatically on a carton.

A common conventional carton sealer uses a brown yellow plastic glued tape or a transparent plastic tape in sealing cartons, impossible to use tapes made of brown packing paper, which has different physical feature from the aforesaid tapes.

However, the aforesaid plastic tapes become useless after being taken down off cartons, discarded as garbage. As widely known, plastic does not biologically degrade for a long time, polluting our environment, and underground water, to give large impact to our daily life. In addition, if it is burned, it will give off toxic gas to impair our health. So, the pressing tendency nowadays is to make as little use of plastic for bags or tapes as possible.

SUMMARY OF THE INVENTION

A main purpose of the invention is to offer a carton sealer using a paper tape for sealing an upper cap and a bottom portion of a carton automatically by means of an upper and a lower tape machine.

Another purpose of the invention is to offer a carton sealer provided with a contact wheel unit behind the upper tape machine for applying once more pressing action to the already adhered tape on a carton, ensuring the tape adhered firmly.

Another purpose of the invention is to offer a carton sealer provided with a water container with constant temperature to supply water to a brush to give moisture to the glue of a paper tape so as to obtain good viscosity of the paper tape to be sealed on.

Another purpose of the invention is to offer a carton sealer provided with a plate unit for holding a paper tape for a cutter to cut at a proper time so that the tape may be moisturized and have considerable tension, not liable to be torn off.

One more purpose of the invention is to offer a carton sealer provided with a push wheel and a press wheel held on a same shaft with cooperation of a spring and an air cylinder for obtaining proper adhering pressure with elastic pulling to suit to different tension of paper tapes.

BRIEF DESCRIPTION OF DRAWINGS

This invention will be better understood by referring to the accompanying drawings, wherein.

DESCRIPTION OF THE PREFERRED EMBODIMENT

Figure 1:
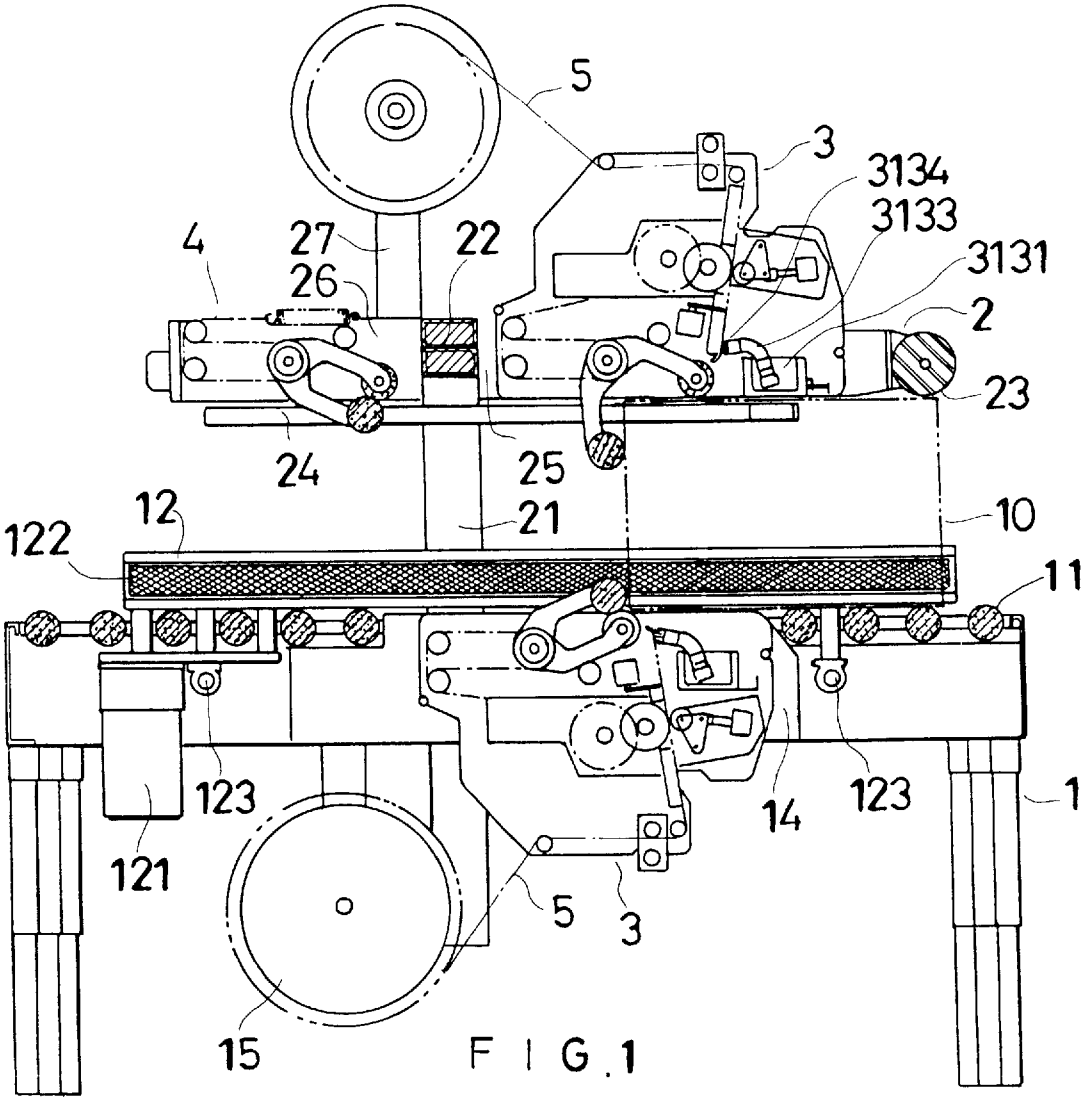
FIG. 1 is a front view of a preferred embodiment of a carton sealer in the present invention.
Figure 2:
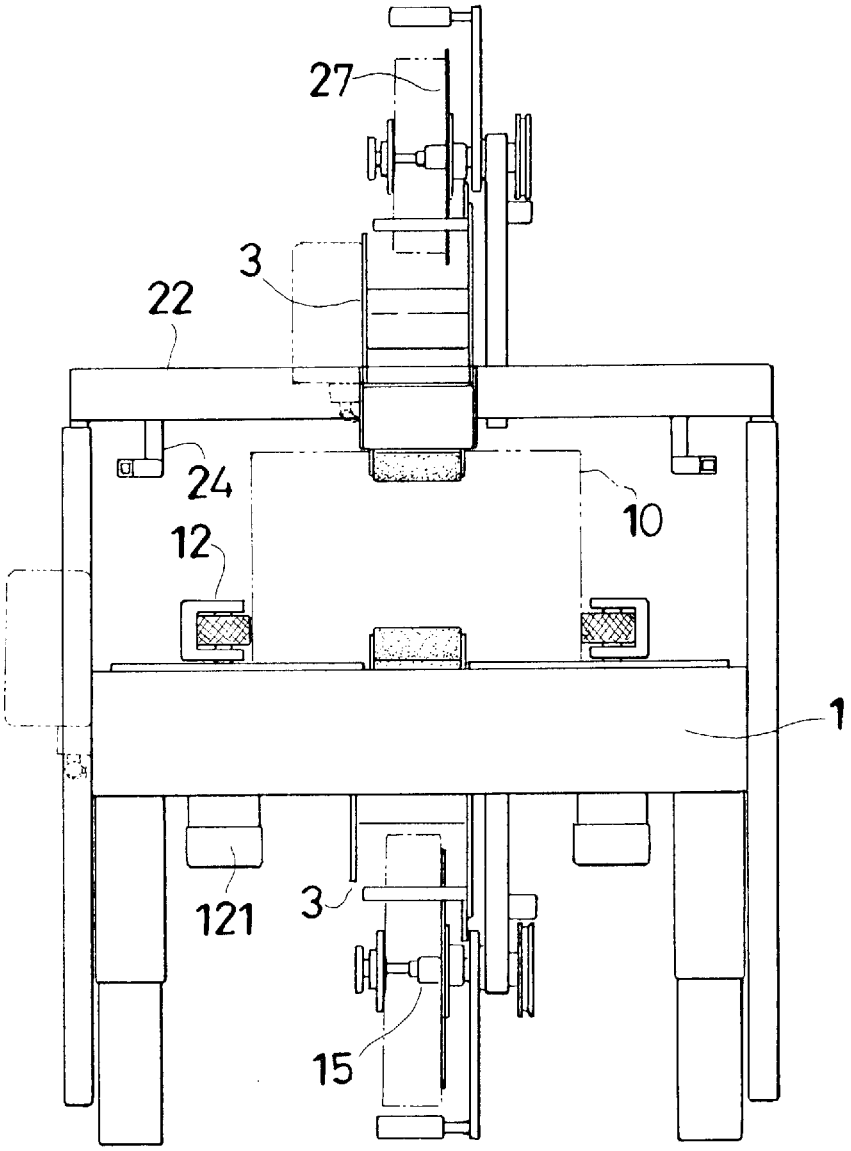
FIG. 2 is a side view of the preferred embodiment of a carton sealer in the present invention.
Figure 3:
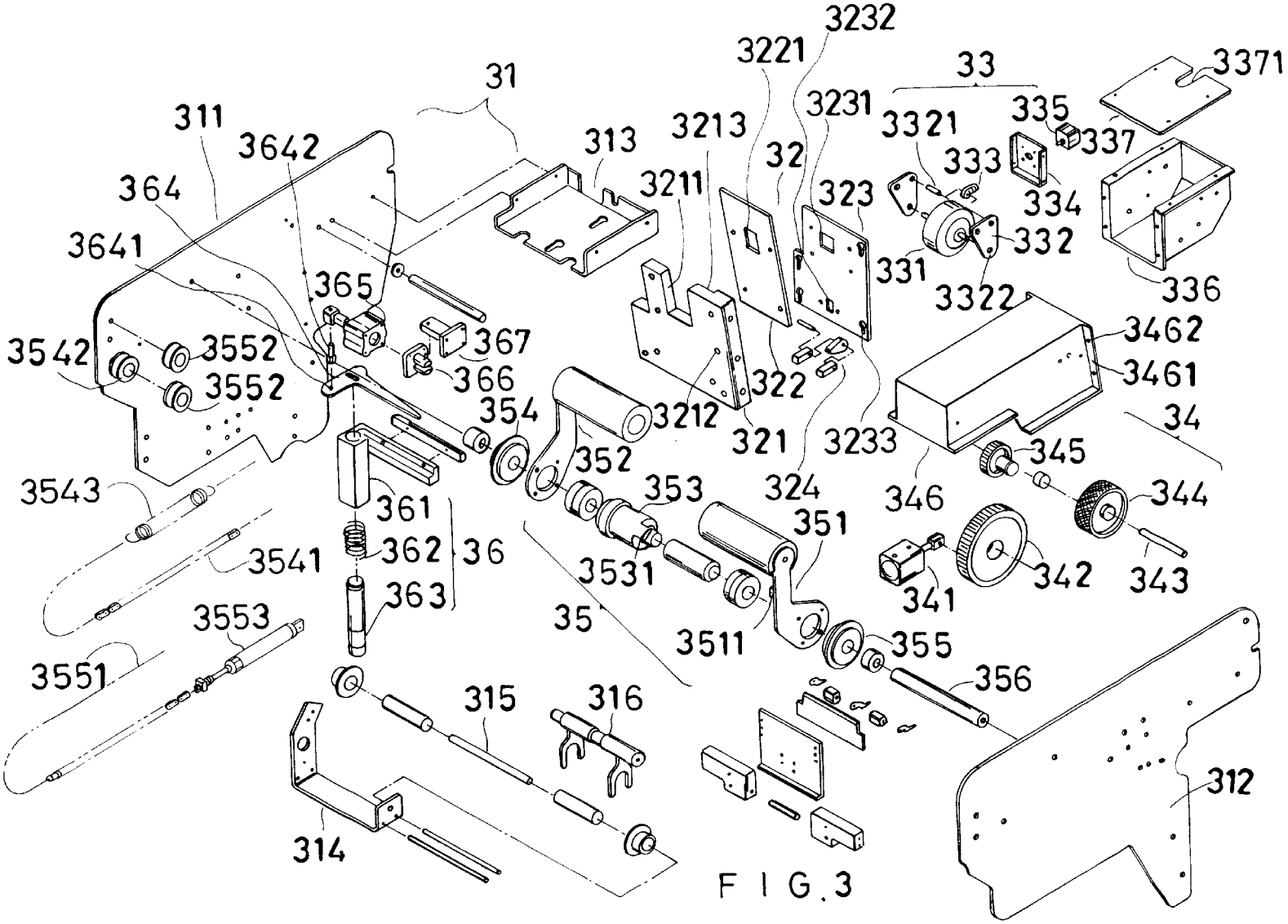
FIG. 3 is an exploded perspective view of a tape machine of the carton sealer in the present invention.
Figure 5:
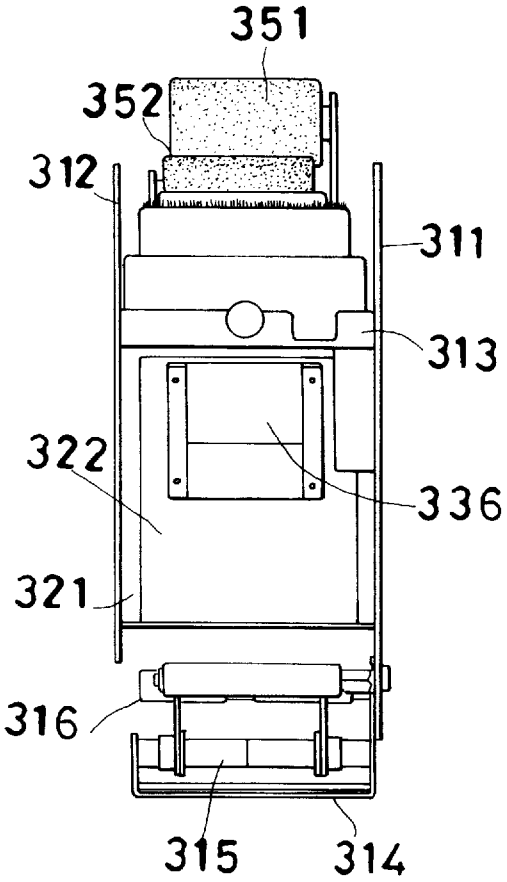
FIG. 5 is a right side view of the tape machine of the carton sealer in the present invention.
Figure 4:
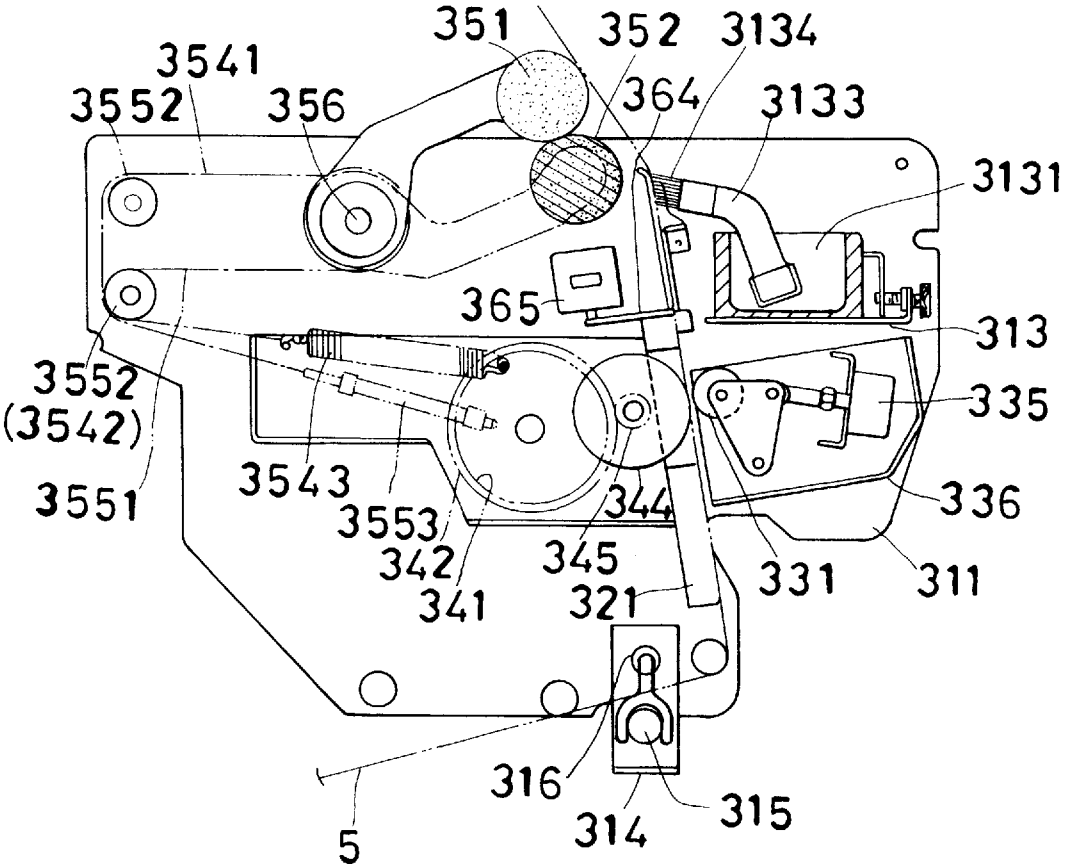
FIG. 4 is a cross-sectional view of the tape machine of the carton sealer in the present invention.
Figure 7:
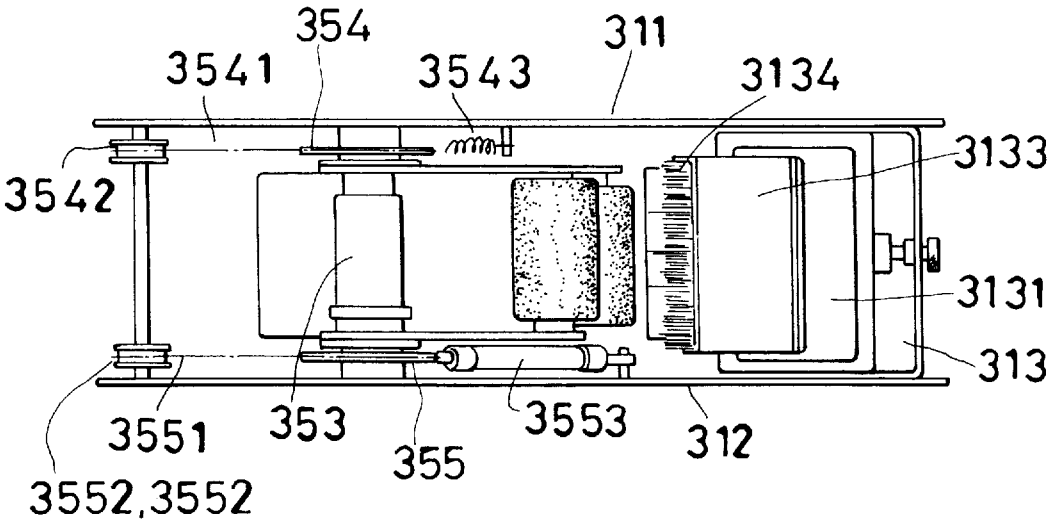
FIG. 7 is an upper view of the tape machine of the carton sealer in the present invention.
Figure 6:
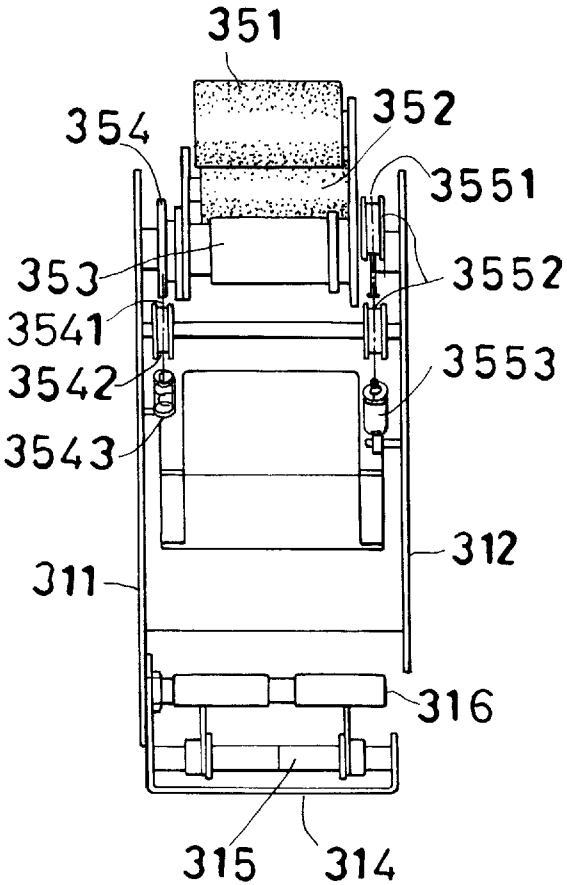
FIG. 6 is a left side view of the tape machine of the carton sealer in the present invention.

A preferred embodiment of a carton sealer in the present invention, as shown in FIGS. 1–7, includes a work table 1, an elevator 2, two tape machines, and a press contact wheel unit 4 as main components combined together.

The work table 1 includes a roller unit 11, a conveyer 12 consisting of a motor 121, a conveyer belt 122 for moving cartons 10, and a threaded rod 123 for adjusting the conveyer belt 122 to match cartons to be moved thereon. Further, the work table 1 includes a tape machine chamber 14 under the work table 1 for depositing a lower tape machine 3 therein, and a wheel frame 15 below the table 1.

The elevator 2 includes a vertical post 21 stand on the work table 1 and a horizontal beam 22 fixed on the vertical post 21, a guide wheel unit 23 in a front side for folding caps of a carton so as to let the carton smoothly move on the table 1. The elevator 2 further has a guide frame 24 under the horizontal beam 22 so as to be moved back and forth in order to limit the position of a carton and to guide it to move forward smoothly. Further, the elevator 2 has an upper tape machine chamber 25 in a front portion of its interior and a rear base 26 in a rear portion of its interior so that an upper tape machine 3 and the press contact wheel unit 4 may be deposited therein. In addition, a wheel frame 27 is provided at a proper point on the elevator 2.

Each of the two tape machines 3 includes a plate unit 31, a clamp plate unit 32, a press wheel unit 33, a transmit unit 34, a contact wheel unit 35 and a cutter unit 36 as its components combined together.

The plate unit 31 consists of a main plate 311 and an auxiliary plate 312 respectively provided with many corresponding holes for combining other components between the plates 311, 312. Further, a case 313 is provided at a front end of the plate unit 31, and an L-shaped frame 314 is fixed at a bottom for fixing a guide wheel unit 315 and a width adjusting rod 316.

The clamp plate unit 32 consists of a thick plate 321, a guide plate 322, a press plate 323, and a contact block unit 324 combined together.

The thick plate 321 is slightly inclined, having a notch 3211 on an upper side, a plurality of threaded holes 3212 and a recess 3213 in the upper side.

The guide plate 322 is fitted in the recess 3211, having a rectangular hole 3221 to face a rectangular hole 3231 of the press plate 323.

The press plate 323 has the rectangular hole 3231 and another hole 3232 in a lower portion for combining the contact block unit 324, and combine holes 3233 each consisting of a large hole and a small hole around an outer circumference.

The press wheel unit 33 consists of a press wheel 331, two push plates 332, 332, a connect shaft 333, a stationary plate 334, an air cylinder 335, a housing 336, and a lid 337 combined together.

The press wheel 331 has a proper softness in its circular surface, pivotally connected with the two push plates 332, 332.

The two push plates 332, 332 are also connected with a shaft 3321 at an upper end, and the shaft 3321 is also pivotally connected with the connect shaft 333.

The stationary plate 334 is fixed with the air cylinder 335, with an output shaft of the air cylinder 335 protruding through the stationary plate 334 to connect with the connect shaft 333. Then the stationary plate 334 with the related components are deposited in the housing 336, with the two push plates 332, 332 having their lower holes 3322, 3322 pivotally connected with the housing 336 and functioning as fulcrums to be pushed by the air cylinder 335 to force the press wheel 331 to move near to the paper tape on the clamp plate unit 32 to keep it in a properly tense condition.

The lid 337 closes on the housing 336, having a notch 3371 in a side for a pipe of the air cylinder 335 to pass through.

The transmit unit 34 consists of a power source 341, a large gear 342, a shaft 343, a transmit wheel 344, a small gear 345 and a case 346 combined together.

The power source 341 may be a motor or an air cylinder to connect and move the large gear 342 engaging the small gear 345, which is connected with an rotates the transmit wheel 344 extending in the notch 3211 of the thick plate 321 and moves the tape with cooperation of the press wheel 331.

Then the transmit unit 34 is deposited in the case 346, which is then combined with the thick plate 321 by means of a projecting edge 3461 of both sides of a rear end and holes 3462 with screws.

The contact wheel unit 35 consists of a following wheel 351, a press wheel 352, a turning member 353, a push gear 354, a press gear 355, and a center shaft 356.

The following wheel 351 and the press wheel 352 are positioned in an opposite position, fixed with the press gear 355 and with the push gear 354, respectively. Further, the turning member 353 is connected with one side of the following wheel 351, having a projection 3531 to contact a micro switch 3511 so as to control the air cylinder 3553 in its operation.

Around the push gear 354 extends a first endless chain 3541, which also extends around a first roller 3542 elastically pulled by a spring 3543. Further, a second endless chain 3551 extends around the press gear 355 and around second rollers 3552, pulled by the air cylinder 3553.

The cutter unit 36 consists of a shaft housing 361, a spring 362, a shaft 363 and a cutter 364. The cutter has a hole 3641 at one side for a shaft 3642 to fit through to connect with an air cylinder 365, which has an end base 366 to pivotally connect with a T-shaped base 367 fixed with the auxiliary plate 312. Then the cutter 364 cuts the tape at the proper time, moved by the air cylinder 365.

After the above mentioned components are assembled together, as shown in FIGS. 4–7, the tape 5 extends from the wheel frame 15, 27, guided by the guide wheel 315 on the L-shaped frame 314 and the width adjusting rod 316 to move between the thick plate 321 and the guide plate 322 to reach th e following wheel 351 and the press wheel 352. Then the tape 5 is moved forward by the transmit wheel 344 with cooperation of the press wheel 331. A water container 3131 with constant temperature is provided with the work table 1, supplying water of proper temperature to a container 3131 in the case 313. Then water flows through a curved arm 3133 to a brush 3134 fixed at an outer end of the arm 3133, and then the brush moisturizes with water brushes the glue on the tape 5 so as to increase viscosity and adhesiveness to the tape 5.

The press wheel unit 4 has a structure similar to that of the contact wheel unit 35 of the tape machine 3, and therefore not to be described in detail here again. The press wheel unit 4 consists of a following wheel, a press wheel, a turning member, a push gear, a press gear, and a center shaft. The following wheel and the press wheel are located in an opposite direction, and respectively fixed to the press gear and the push gear, with the following wheel connected on the inside, with the turning member having a projection extending therefrom. Around the push gear extends a third endless chain, which also extends around a third roller elastically pulled by a spring. Around the press wheel extends in an opposite direction a fourth endless chain, which also extends around a fourth roller pulled by an air cylinder.

Figure 8:
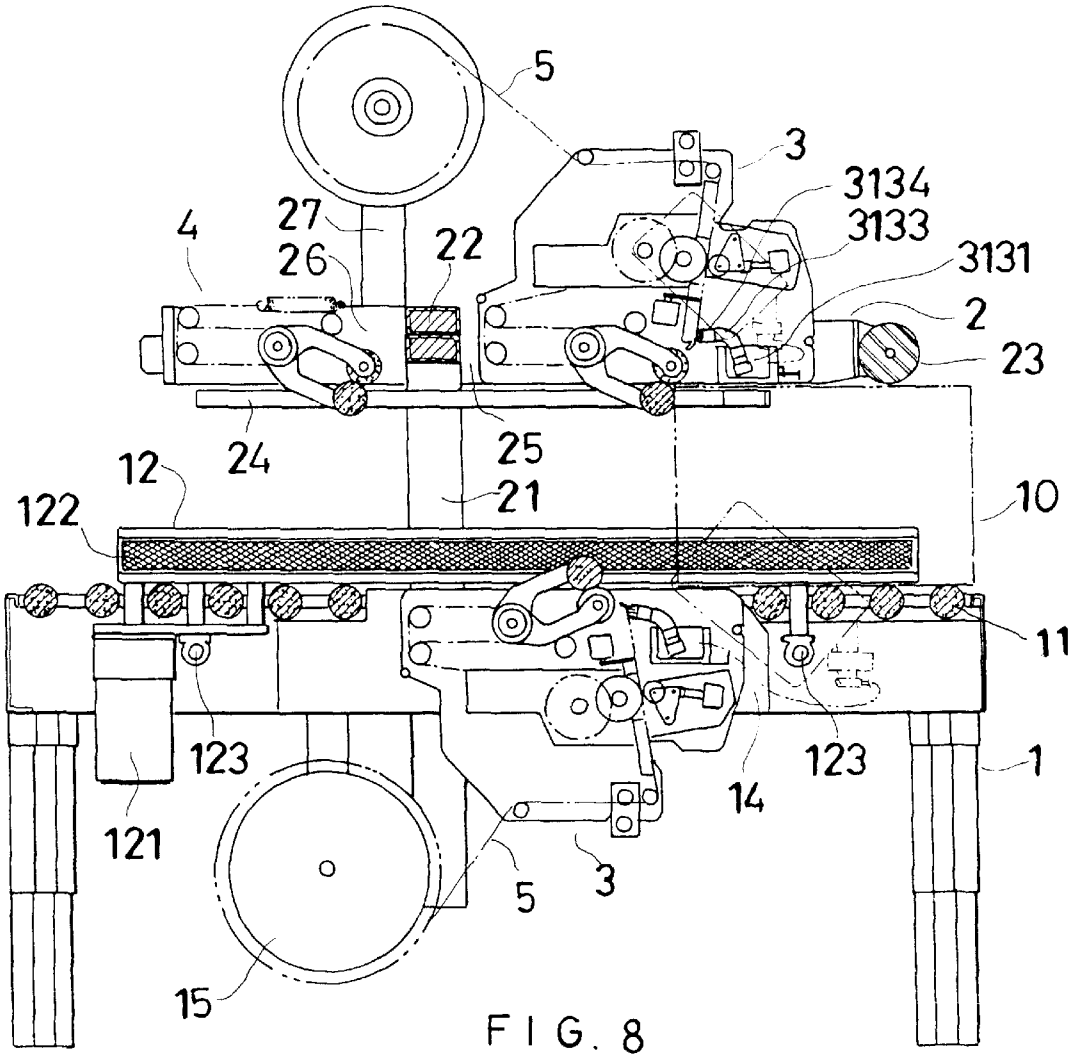
FIG. 8 is a front view of the carton sealer in the present invention, showing it being in a kind of motion.
Figure 9:
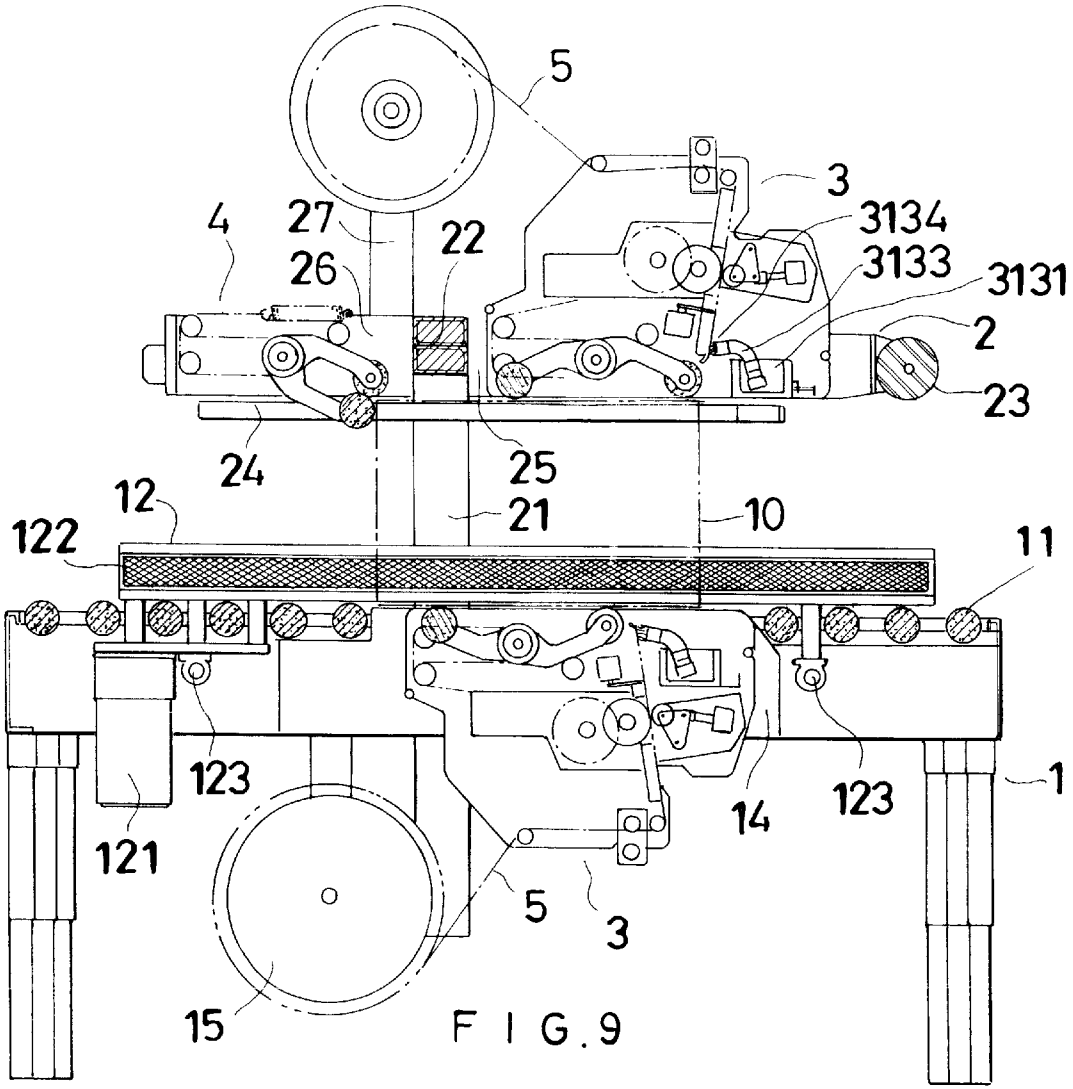
FIG. 9 is a front view of the carton sealer in the present invention, showing it being in another kind of motion; and, FIG. 10 is a perspective view of a contact wheel of the carton sealer in the present invention, showing its moving direction.
Figure 10:
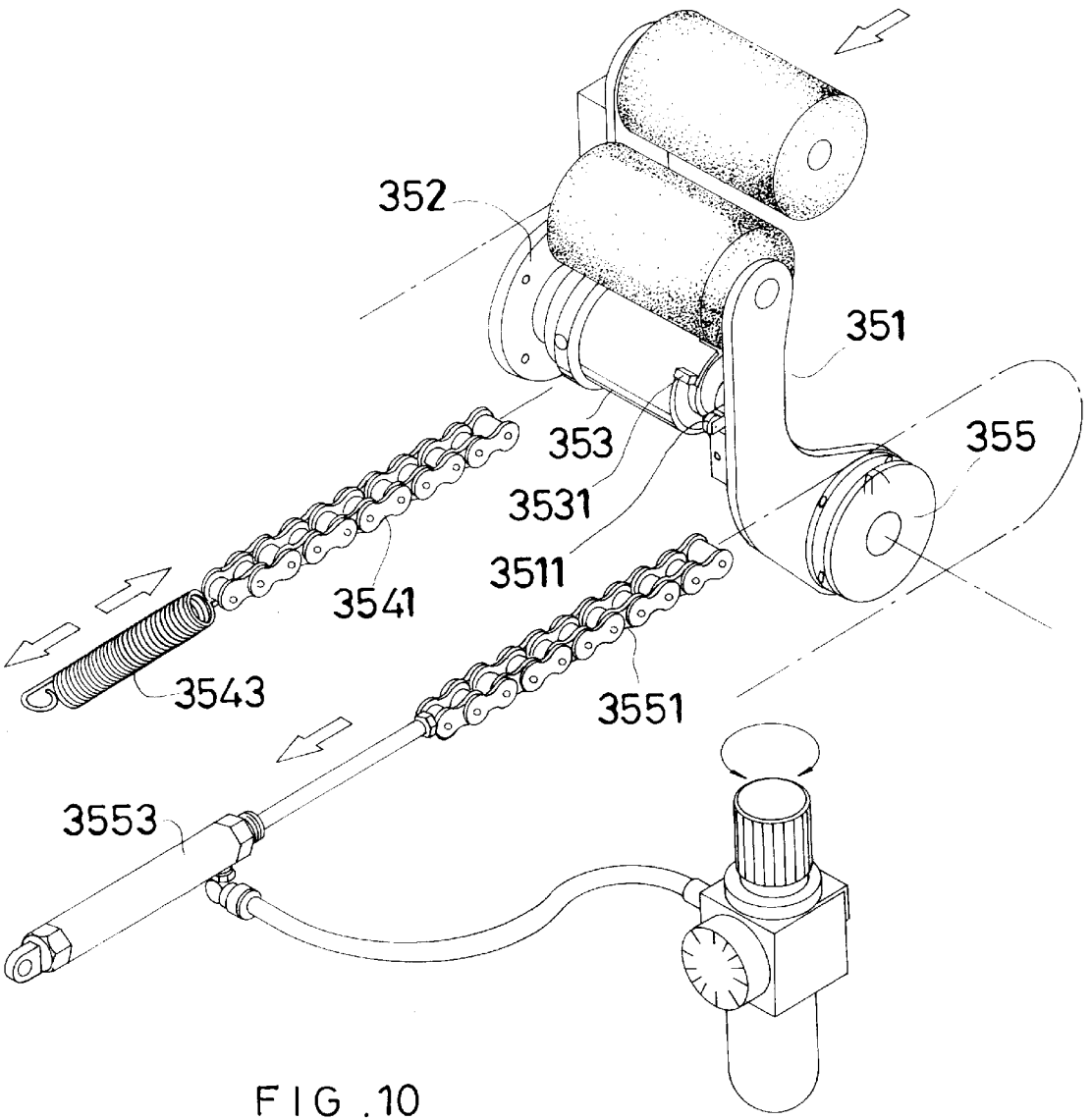

Referring to FIGS. 1, 8, 9 and 10, when a carton 10 is moved in on the table 1, it goes to touch the contact wheel 351 of the tape machine 3 on an upper position, and begins to be adhered with a tape 5 coming from the upper tape machine 5 as shown in FIG. 8. Then the contact wheel 351 continues to move forward together with the carton being moved, with the micro switch 3511 separating from the projection 3531 of the turning member 353, and with the air cylinder 3553 moving to touch the micro switch 3511 to be stopped. Then the spring 3543 pulls the contact wheel 351 and the press wheel 352 back to its original position, finishing one round of sticking a tape on a carton. The carton sealer using a paper in the invention has two features as follows.

What is claimed is:

1. A carton sealer using paper tapes, comprising:

(a) a work table including a roller unit and a conveyer, said conveyer having a motor and a conveyer belt for moving a carton;

(b) a lower tape machine chamber located in a lower portion of said work table and receiving a lower tape machine therein;

(c) a lower tape wheel frame combined with said lower tape machine;

(d) an elevator including a vertical post standing on said work table and a horizontal beam fixed on said vertical post;

(e) a guide wheel unit fixed in front of said elevator for pressing down foldable caps of the carton so as to let the carton move forward smoothly on said conveyer belt;

(f) a guide frame provided in a lower portion of said elevator for limiting the position of the carton and guiding it to move forward;

(g) an upper tape machine chamber provided in an interior of a front portion of said elevator and receiving an upper tape machine therein;

(h) a rear base located in a rear portion of said interior of said elevator for receiving a rear press wheel unit;

(i) an upper tape wheel frame combined with said upper tape machine;

where each of said two tape machines respectively including a plate unit, a clamp plate unit, a tape machine press wheel unit, a transmit unit, a contact wheel unit and a cutter unit, a paper tape being hung on a respective one of said two tape wheel frames and extending around a tape machine guide wheel unit fixed on an L-shaped frame, and then extending between a thick plate and a guide plate of said clamp plate unit and reaching a tape machine following wheel of said contact wheel unit, said paper tape then being easily moved forward by a transmit wheel of said transmit unit in cooperation with a tape machine press wheel of said press wheel unit, each said tape machine further respectively having a water container of constant temperature fixed to said work table for supplying water of proper temperature to a water case, said water case then supplying water to a curved arm and then to a brush attached on an outer end of said curved arm, said brush brushing and coating water on the glue on said paper tape so as to increase viscosity and adhesiveness of said paper tape; and, (j) a second press wheel unit having a structure similar to that of said contact wheel units of said tape machines and consisting of a second following wheel, a second press wheel, a turning member, a push gear, a press gear and a center shaft, said second following wheel and said second press wheel being positioned in an opposite direction, said second following wheel being fixed to said press gear, said second press wheel being fixed to said push gear, said second following wheel being further fixed to said turning member, said turning member having a projection extending therefrom, a third endless chain extends around said push gear and around a third roller, said third endless chain being pulled by a screen, a fourth endless chain extends around said press gear and around a fourth roller pulled by an air cylinder of said second press wheel unit;

wherein the carton is placed and moved on said table to contact said tape machine following wheel of said upper tape machine and then said tape begins to be adhered on said carton, the carton further being moved and carrying said following wheel forward together until said projection of said turning member separates from a micro switch, said spring then pulling back said second following wheel and said second press wheel to their original position to finish one tape sealing cycle.

2. The carton sealer using paper tapes as claimed in claim 1, wherein each said tape machine comprises:

said plate unit consisting of a main plate and an auxiliary plate, said main plate and said auxiliary plate respectively having a plurality of corresponding holes for mounting of components therebetween, a case being disposed in a front end of said plate unit;

said clamp plate unit consisting of said thick plate, said guide plate, a press plate and a contact block unit, said thick plate being slightly inclined and having a notch and a recess formed in an upper side and a plurality of threaded holes formed therein, said guide plate fitting in said notch of said thick plate and having a first rectangular hole facing a second rectangular hole of said press plate, said press plate having a hole formed below said second rectangular hole for combination with said contact block unit, and a plurality of combine holes spaced around an outer circumference of said press plate;

said tape machine press wheel unit consisting of said tape machine press wheel, two push plates, a connect shaft member, a stationary plate, a tape machine press wheel air cylinder, a housing and a lid, said tape machine press wheel having a soft circular surface and being pivotally connected to said two push plates on two sides thereof, each said push plate being combined together by a first shaft, said first shaft then being connected pivotally with said connect shaft member, said tape machine press wheel air cylinder being connected with said stationary plate and having its output shaft connected with said connect shaft member, said tape machine press wheel unit being disposed in said housing, said two push plates being respectively pivotally coupled to said housing, said tape machine press wheel air cylinder pushing said press wheel to move nearer to said paper tape located in said clamp plate unit so as to keep said tape in a tensioned condition, said lid closing on said housing and having a notch for an inlet pipe of said tape machine press wheel air cylinder to pass therethrough:

said transmit unit consisting of a power source, a large gear, a second shaft, said transmit wheel, a small gear and a case, said power source being a transmit motor or a transmit unit air cylinder and rotating said large gear engaging with said small gear, said small gear and said transmit wheel both being fixed on said second shaft to rotate together, said transmit wheel extending in said notch of said thick plate and rotating to move said tape in cooperation with said tape machine press wheel, said tape machine transmit unit being disposed in said case, said case being coupled to said thick plate;

said contact wheel unit consisting of said following wheel, a contact press wheel, a contact turning member, a contact push gear, a contact press gear and a contact center shaft, said tape machine said following wheel and said contact press wheel being located in an opposite direction, said tape machine following wheel being fixed to said contact press gear, said contact press wheel being fixed with said contact push gear, said tape machine following wheel being fixed to said contact turning member, said turning member having a contact projection for touching a contact micro switch to control a contact air cylinder of said contact wheel unit, a first endless chain extends around said contact push gear and extends around a first roller pulled by a contact spring, coupled thereto a second endless chain extends around said contact press gear and extends around a second roller pulled by said contact air cylinder of said contact wheel unit; and, a cutter unit consisting of a shaft housing, a twist spring, a third shaft and a cutter, said cutter having a contact hole in an upper side for a fourth shaft to pass through to connect to a cutter unit air cylinder, said cutter unit air cylinder having an end base to connect pivotally with a T-shaped base, said T-shaped base being fixed to said auxiliary plate, said cutter being moved by said cutter unit air cylinder for cutting said tape.

* * * * *